US005701356A

United States Patent [19]

Stanford et al.

[11] Patent Number: 5,701,356

[45] Date of Patent: Dec. 23, 1997

[54] NECK ENGAGEABLE TRANSDUCER SUPPORT ASSEMBLY AND METHOD OF USING SAME

[75] Inventors: Thomas H. Stanford, Escondido; Farhad Noroozi Sahne, San Diego; Thomas P. Riches, Temecula; Robert O'Neill, San Diego, all of Calif.

[73] Assignee: HM Electronics, San Diego, Calif.

[21] Appl. No.: 567,154

[22] Filed: Dec. 5, 1995

[51] Int. Cl.[6] ..... H04R 25/00

[52] U.S. Cl. ..... 381/187; 381/183; 455/100; 455/89; 455/90

[58] Field of Search ..... 381/183, 187, 381/24, 25, 87; 455/100, 89, 90

[56] References Cited

U.S. PATENT DOCUMENTS

| | | | |
|---|---|---|---|
| 2,710,345 | 6/1955 | Stephens | 455/100 |
| 4,057,757 | 11/1977 | Darden, Jr. | 455/90 |
| 4,057,794 | 11/1977 | Grossfield | 455/100 |
| 4,084,139 | 4/1978 | Jakobe | 381/24 |

*Primary Examiner*—Sinh Tran

*Attorney, Agent, or Firm*—Bernard L. Kleinke; Peter P. Scott

[57] ABSTRACT

The transducer support assembly includes a transducer secured to a U-shaped strap having a pair of chest engageable leg portions connected integrally to a curved neck engageable portion by a pair of twisted intermediate portions for engaging the body of the user. The chest engageable leg portions are adapted to fit over the shoulders and to lie substantially flat against the chest of the user. A wide portion of the neck engageable portion extends in overlying substantially continuous engagement with the neck or back of the user to resist the chest engageable leg portions from swinging away from the chest. A gripping material forms an underside surface of the strap to frictionally engage the user, thereby inhibiting the strap from moving relative to the body of the user. Another transducer support assembly includes a flexible U-shaped neck support having a chest engageable portion. A transducer secured within a transducer support is coupled slidably to the chest engageable portion to enable it to be selectively positioned relative to the chest engageable portion.

25 Claims, 4 Drawing Sheets

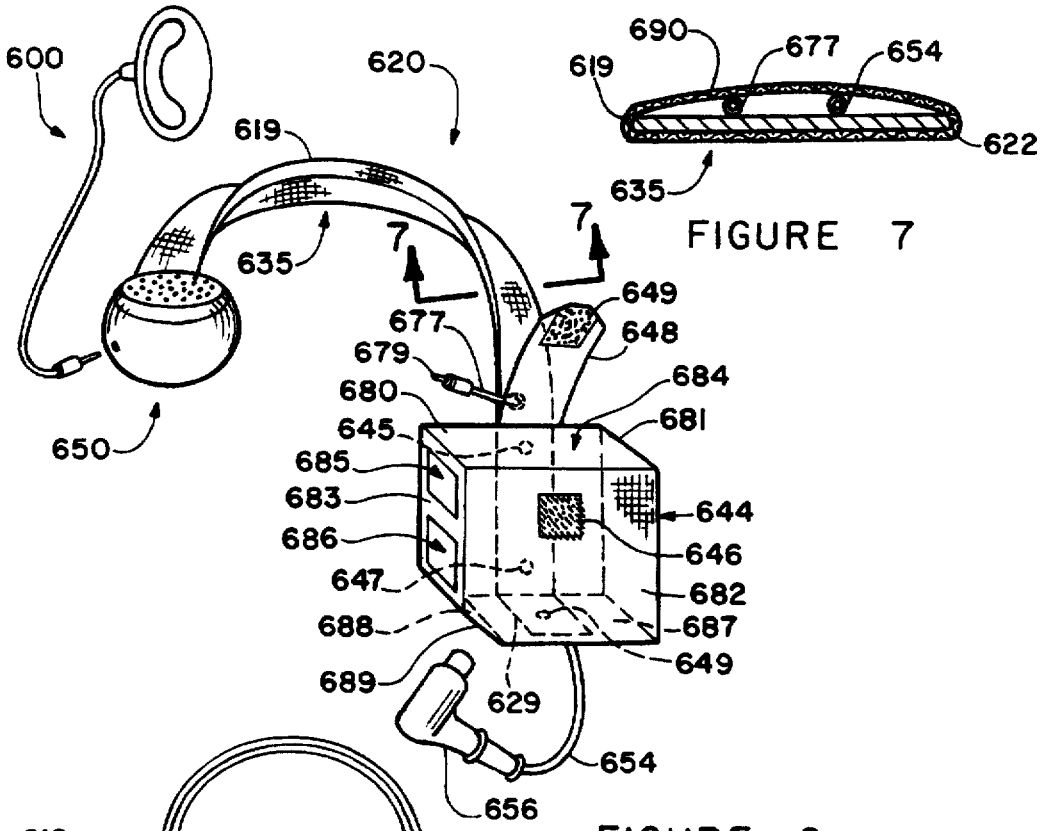
FIGURE 7
FIGURE 6
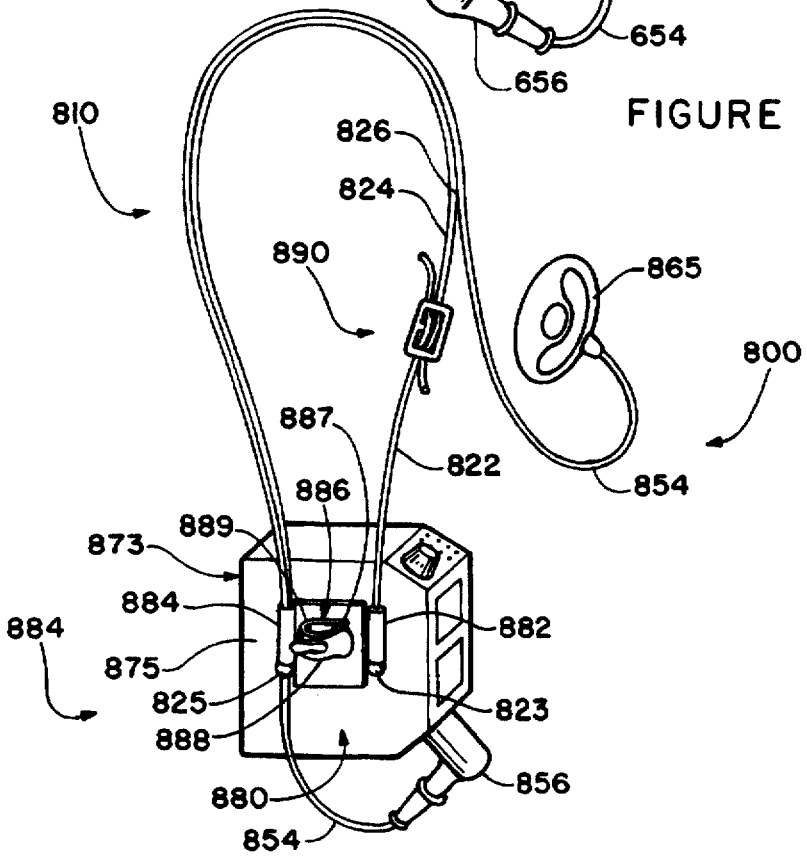
FIGURE 8

NECK ENGAGEABLE TRANSDUCER SUPPORT ASSEMBLY AND METHOD OF USING SAME

TECHNICAL FIELD

The present invention relates in general to a wearable communication device, and a method of using it. The invention more particularly relates to a new and improved transducer support assembly that is adapted to be worn about the neck of a user in a convenient manner, and which is used according to a novel method.

BACKGROUND ART

There have been many types of communication devices for facilitating the communication of information, including a handset communication device. Such a handset communication device enabled a user to effectively communicate. However, the user was not permitted the free use of both hands to perform other tasks while using the handset communication device.

Where the user must communicate and perform other tasks at the same time, the use of a headset having a speaker and a microphone supported by a headband has proven to be an effective communication device. For example, workers monitoring telephone calls in a business office, and order takers in a fast food restaurant, are able to communicate with others while wearing a headset. In this manner, they can simultaneously perform other tasks with their hands. An example of such a headset is disclosed in U.S. Pat. No. 4,875,233, which is incorporated by reference as if fully set forth herein.

Headsets, such as the headset described in U.S. Pat. No. 4,875,233, were adapted to be worn on the head of the user. The headset included a speaker housing attached to a headband for positioning a speaker within the speaker housing adjacent to an ear. The headset further included a microphone boom extending forwardly from the speaker housing for positioning the microphone in the vicinity of the mouth.

A transceiver unit connected to the headset by a cable, and which was worn about the waist of the user, enabled the user to be mobile without worrying about becoming entangled in a long cable connecting the communication device to a remote connection point. Although such headsets have worked satisfactorily for many applications, they have some disadvantages because they must necessarily be worn on the head.

In this regard, the headset had to be adjusted to accommodate each one of the various heads that was to receive the headset. To secure the headset on the head, the headband was adjusted until it caused the headset to slightly squeeze the head. As a result, the headset was maintained frictionally in the desired position. After wearing the headset for an extended amount of time, the user could become uncomfortable due to the pressure being applied to the head. Furthermore, the pressure applied by the headset tended to put the hair style of the user in a state of disarray.

For some users, especially those in fast food restaurants that tend to be relatively young, disturbing the hair of the user was unacceptable. To avoid this result, the user was tempted to wear the headset improperly to minimize the disarray of the hair. An improper fitting of the headset reduced the effectiveness of the communication device, and increased the likelihood that the headset would fall off of the head accidentally.

Another disadvantage of the headset communication device was its susceptibility to being damaged. Generally, the headset was lightweight and relatively small to reduce the discomfort felt by the user. The components of the headset, including the speaker, microphone and transceiver, were constructed of electronic equipment that were not designed to withstand an impact with a hard surface. As a result of the minimal construction of the headset, the headset was somewhat fragile and could be damaged easily.

The fragility of the headset was most apparent when the headset was dislodged from the head of the user. In this regard, the headset relied on friction for helping to maintain its position on the head. Therefore, an inadvertent force could overcome the frictional force and cause the headset to become misaligned on the head, or even dislodged therefrom. Should the headset become dislodged from the head, the headset could fall to the ground, resulting in the possibility of damage to the headset and its fragile components.

One source of an inadvertent force that could cause the headset to be dislodged related to the cable connecting the headset to the transceiver. The cable was exposed outside of the clothing of the user. Objects that engaged the cable as the user moved about could pull on the cable, thereby pulling forcibly on the headset to dislodge it from the head of the user.

Where the user is required to bend over, the downward pull on the headset by gravity could cause the headset to become dislodged from the head. As discussed previously, the headset could fall to the ground and be damaged once it is dislodged. In come circumstances, the headset could be damaged by falling onto the work surface that the user was bending over, such as a hot grill or a vat of boiling cooking oil.

In addition to being dislodged from the head, the headset was also susceptible to damage due to the proximity of the transceiver to the work surface. In this regard, work surfaces tended to be at about waist level. While performing tasks, a user would often inadvertently contact the work surface at the waist of the user. Therefore, the possibility of accidental damage to the transceiver worn at the waist was increased.

Another type of communication device which permitted the user to communicate while performing tasks with both hands was a necklace type communication device, such as the device described in U.S. Pat. No. 4,993,065, which is incorporated by reference as if fully set forth herein. The necklace communication device included a collar member made from a flexible metal tube having an opening in the rear portion thereof for encircling the neck of the wearer like a necklace. The opening permitted the collar member to be adjusted to fit around the neck of the wearer.

A pair of earplugs adapted to be received within the ears of the wearer were connected to a transmitter housing secured to the forward portion of the collar member. The earplugs were detachably secured to the collar member to permit the wearer to select one, or both, of the ear pieces as desired. A microphone attached to the transmitter housing enabled the wearer to transmit as well as receive communications. To connect the ear pieces and the microphone to an external source, a pair of cables coupled to the housing were provided.

Although the necklace communication device permitted the wearer to have both hands free while communicating, the necklace communication device was not suitable for wearers that needed to move about and bend over while communicating. In this regard, the movement of the collar member was not limited. For example, a force exerted on the cables could cause the collar member to rotate about the neck of the wearer. As a result, the microphone could move away from its desired position in front of the mouth. With the microphone rotated away from the mouth, the effectiveness of the microphone was reduced.

In addition, the swinging of the collar member away from the body of the wearer was not limited. Leaning forward could cause the transmitter housing and the microphone to swing away from the body and toward the mouth of the wearer. Thus, the distance between the microphone and the mouth could be unexpectedly varied, thereby inducing undesired audio effects. Also, the swinging of the transmitter housing and the microphone away from the body could interfere with the performance of tasks by the wearer.

With regard to the ear pieces of the necklace communication device, the ear pieces were required to be placed within the ears of the wearer. Such a placement was invasive into the ear cavity, causing discomfort to the wearer. In addition, concerns of sanitation arise, especially where the communication device was shared by more than one wearer.

Another disadvantage to the necklace communication device is the lack of a provision for wireless communication. The cables required to couple the communication device to a remote source limit the mobility of the wearer, and could also interfere with the performance of the duties of the wearer.

Therefore, it would be highly desirable to have a new and improved transducer support assembly which is adapted to attach quickly and conveniently to users of varying sizes and shapes, and which can be worn comfortably for extended periods of time. Such a transducer support assembly should refrain from swinging away from the body of the user and remain in position on the user once the transducer support assembly is in place, and should be relatively inexpensive to manufacture.

DISCLOSURE OF INVENTION

Therefore, the principal object of the present invention is to provide a new and improved transducer support assembly, and a method of using it, wherein the transducer support assembly is adapted to attach quickly and conveniently to users of varying sizes and shapes, and which can be worn comfortably for extended periods of time. Such a transducer support assembly should refrain from swinging away from the body of the user and should remain in position on the user once the transducer support assembly is in place, and should be relatively inexpensive to manufacture.

Briefly, the above and further objects of the present invention are realized by providing a new and improved transducer support assembly that is worn around the neck of the user and which can be placed into position quickly and easily. Once in place, the transducer support assembly should not tend to shift out of position and should also resist swinging away from the body of the user when the user bends forwardly.

The transducer support assembly includes a transducer secured to a U-shaped strap having a pair of chest engageable leg portions connected integrally to a curved neck engageable portion by a pair of twisted intermediate portions for engaging the body of the user. The chest engageable leg portions are adapted to fit over the shoulders and to lie substantially flat against the chest of the user. A wide portion of the neck engageable portion extends in overlying substantially continuous engagement with the neck or back of the user to resist the chest engageable leg portions from swinging away from the chest. A gripping material forms an underside surface of the strap to frictionally engage the user, thereby inhibiting the strap from moving relative to the body of the user. Another transducer support assembly includes a flexible U-shaped neck support having a chest engageable portion. A transducer secured within a transducer support is coupled slidably to the chest engageable portion to enable it to be selectively positioned relative to the chest engageable portion.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 6 is a front view of a further transducer support assembly which is also constructed in accordance with the present invention;

FIG. 7 is an enlarged cross-sectional view of the assembly of FIG. 6, taken substantially on line 7—7 thereof;

FIG. 8 is a rear view of another transducer support assembly which is also constructed in accordance with the present invention;

BEST MODE FOR CARRYING OUT THE INVENTION

Figure 1:
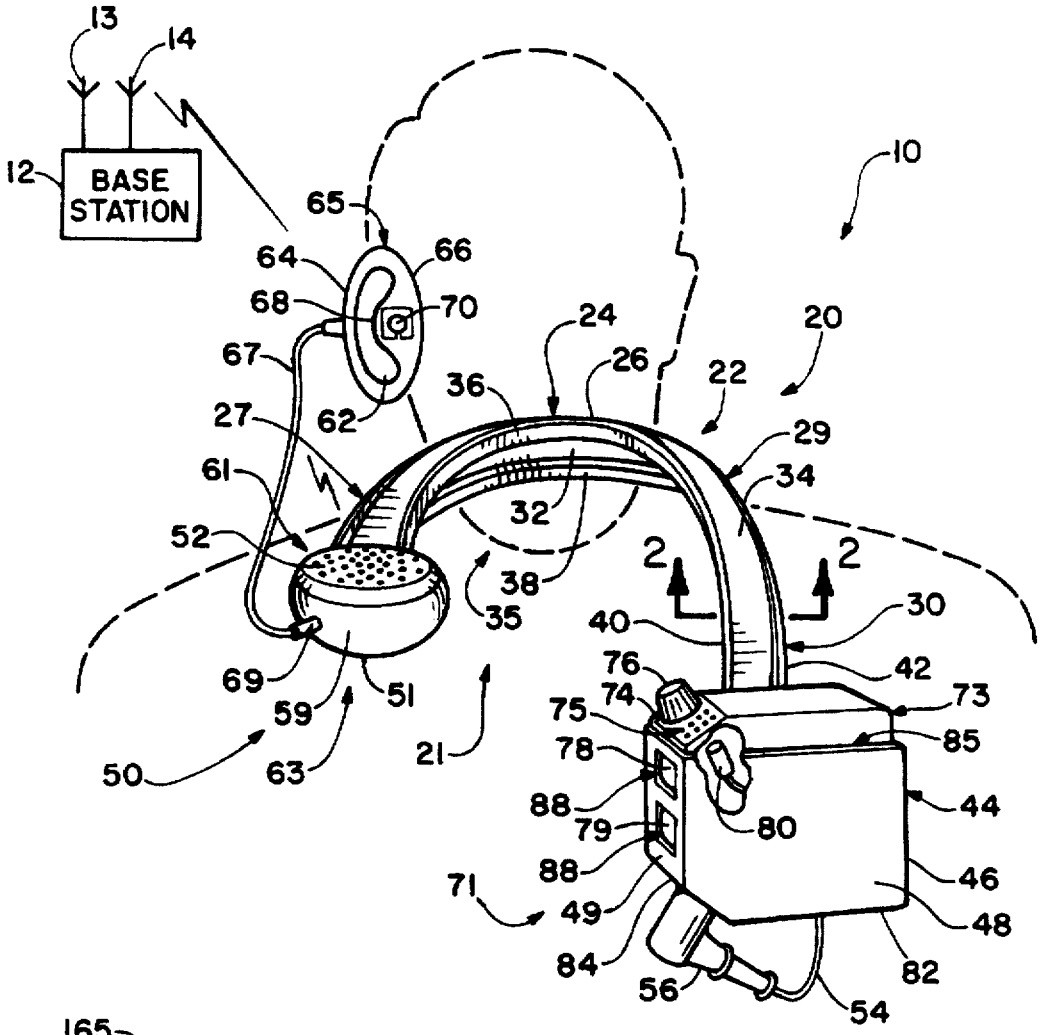
FIG. 1 is a partially cut-away front view of a transducer support assembly which is constructed in accordance with the present invention.
Figure 3:
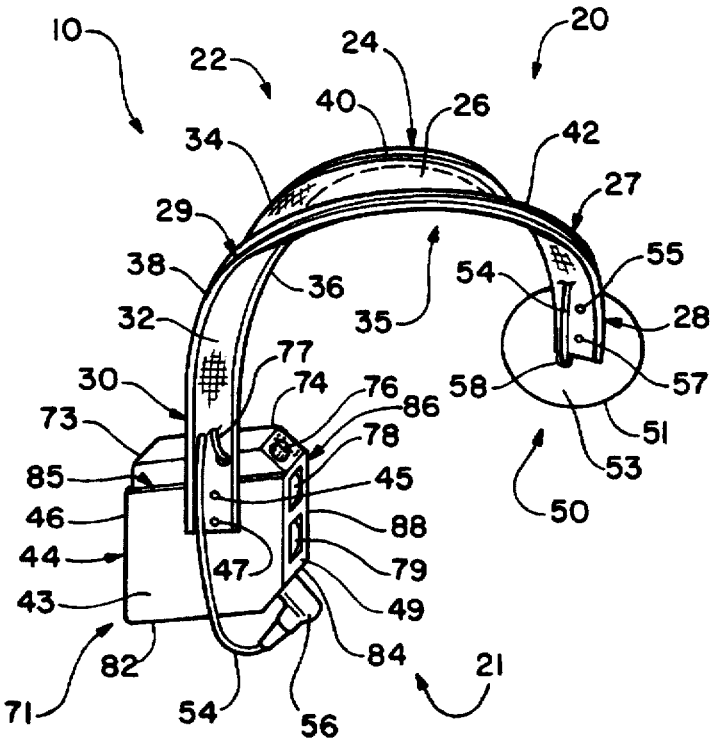
FIG. 3 is a rear view of the assembly of FIG. 1.

Referring now to the drawings, and more particularly to FIGS. 1 and 3 thereof, there is shown a neck engageable transducer support assembly 10, which is constructed in accordance with the present invention. The assembly 10 can be quickly and conveniently positioned on the user to facilitate the communication of audio signals between the user and remote electrical equipment, such as base station 12 having an antenna 13 for receiving a communication and an antenna 14 for transmitting a communication to other wireless transceivers (not shown). An example of a base station which is suitable for use with the present invention is shown and described in U.S. Pat. No. 5,321,848, which is incorporated by reference as if fully set forth herein.

In the preferred embodiment disclosed herein, the assembly 10 communicates with the base station 12 in a wireless manner. However, it will be understood by one skilled in the art that the communication of audio signals between the user wearing the assembly 10 and the base station 12 could be performed via cables to facilitate communication between the assembly 10 and the base station 12 so that the assembly 10, in turn, can communicate in a wireless manner to other transceivers (not shown).

The assembly 10 generally comprises a U-shaped neck support 20 having an elongated strap member 22. The strap member 22 is configured to conform generally to the upper body of the user, and the strap member 22 is constructed from a generally stiff material, such as a thermoplastic material, to enable the strap member 22 to retain its shape. Although in the preferred embodiment the strap member 22 is constructed from a thermoplastic material, other materials which are stiff and which would enable the strap member 22 to retain its shape are also contemplated.

A speaker assembly 50 is coupled to an end of the strap member 22 to facilitate the transmission of an audio signal from the base station 12 to the user. A transceiver 71 is coupled to the other end of the strap member 22 for facilitating wireless communication between the speaker assembly 50 and the base station 12.

In use, the neck support 20 is positioned on the upper body portion of the user. In this regard, the strap member 22 partially encircles the neck of the user to position the speaker assembly 50 on one side of the body of the user adjacent to the ear, and to position the transceiver 71 on the other side of the body adjacent to the mouth, wherein the head of the user is substantially between the speaker assembly 50 and the transceiver 71 to help reduce the occurrence of the feedback.

Figure 2:
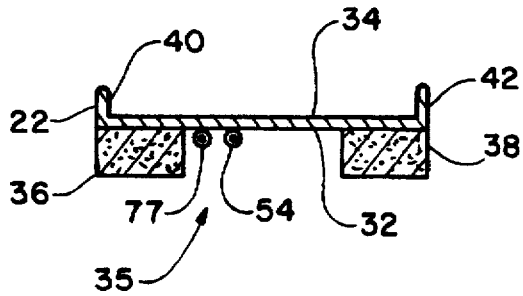
FIG. 2 is an enlarged cross-sectional view of the assembly of FIG. 1, taken substantially on line 2—2 thereof.

Considering now the construction of the U-shaped neck support 20 in greater detail with reference to FIGS. 1–3, the strap member 22 includes a curved neck engageable portion 24 for engaging and conforming to the back of the neck of the user to support the U-shaped neck support 20 from above. A pair of chest engageable leg portions, such as right chest engageable leg portion 28 and left chest engageable leg portion 30, are interconnected integrally to the ends of the neck engageable portion 24 by a pair of twisted intermediate portions, such as right intermediate portion 27 and left intermediate portion 29.

The neck engageable portion 24, the right leg portion 28, the left leg portion 30 and the intermediate portions 27 and 29 form a common continuous underside surface 35 which engages and conforms to the body of the user when the U-shaped neck support 20 is worn by the user. In this regard, the underside surface 35 lies substantially flat on the chest at about the right leg portion 28, and twists away from the chest at about the right intermediate portion 27. The twist of the right intermediate portion 27 enables the underside surface 35 to make the transition from lying flat against the chest to lying flat against the back of the neck at about the neck engageable portion 24.

The curvature of the neck engageable 24 permits the underside surface 35 to lie substantially flat against the back of the neck and to conform thereto. The underside surface 35 is twisted again at about the left intermediate portion 29 to enable the underside surface 35 to lie substantially flat against the chest at about the left leg portion 30. In this way, substantially all of the underside surface 35 engages the body of the user.

In the preferred embodiment, the length of the right leg portion 28 is relatively shorter than the length of the left leg portion 30, resulting in the neck support 20 being substantially hook shaped. In this way, an opening 21 formed by the right leg portion 28 and the left leg portion 30 is made slightly larger to facilitate the placing of the neck support 20 about the neck of the user. The larger opening 21 permits the quick and convenient positioning of the neck support 20 on the user from nearly any angle.

In this regard, the neck support 20 can be placed on the neck of the user at any angle because the shorter right leg portion 28 permits easy access to the opening 21 in the neck support 20. Once the neck of the user has passed through the opening 21, the neck support 20 can be rotated about the neck of the user until the neck support 20 properly engages the body of the user.

It will be understood by one skilled in the art that the left leg portion 30 could be shorter than the right leg potion 28, and still enable the neck support 20 to be positioned on the neck of the user from nearly any angle.

A pair of compressible cushioned or foam strips 36 and 38 help to form the underside surface 35 to frictionally engage the body of the user to facilitate limiting inadvertent shifting movement of the apparatus 10 relative to the body of the user. The strips 36 and 38 are secured to a bottom surface 32 of the strap member 22 by a conventional method.

In order to increase the stiffness of the strap member 22, a pair of oppositely disposed ridges 40 and 42 are connected integrally to either side of the strap member 22, and which ridges 40 and 42 extend upwardly from a top surface 34 of the strap member 22.

Figure 4:
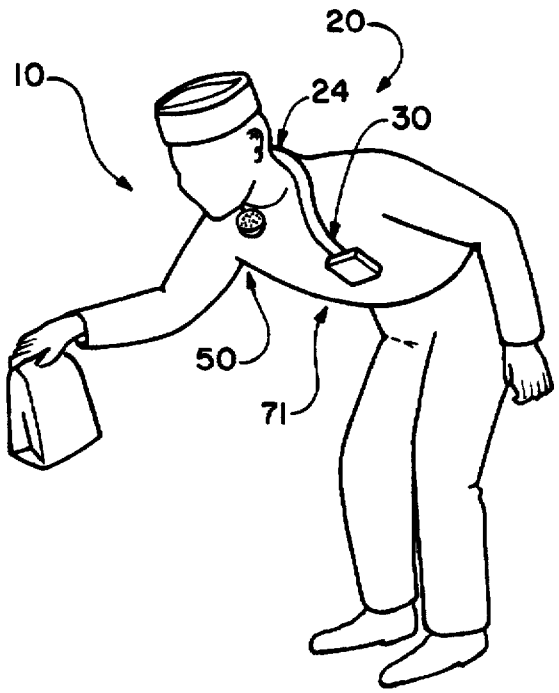
FIG. 4 is a diagrammatical view of the assembly of FIG. 1 being worn by a user.

The neck engageable portion 24 has a wide central portion 26 that is adapted to permit the neck engageable portion 24 to overly the neck in substantially continuous engagement therewith. The wide portion 26 facilitates resisting the underside surface 35 at or about the neck engageable portion 24 from being lifted away from the neck of the user. In this way, the leg portions 28 and 30 are inhibited from swinging away from the body of the user, especially when the user bends forward (FIG. 4).

Considering now the speaker assembly 50 in greater detail with reference to FIGS. 1 and 3, the speaker assembly 50 includes a speaker housing 51 having a side wall portion 59 connected to a bottom surface 53. The speaker housing 51 is secured to the right leg portion 28 via the bottom surface 53 by a pair of rivets 55 and 57. A speaker 52 is secured to the side wall 59 to transmit sound which is representative of an audio signal received from the base station 12. In this regard, the speaker 52 is connected electrically to the transceiver 71 by a cable 54, wherein the cable 54 exits the bottom surface 53 through the hole 58. A plug 56 is connected to the cable 54 for coupling the speaker 52 to the transceiver 71.

The side wall portion 59 is configured to direct the sound transmitted from the speaker 52 towards the ear of the user. In this regard, the side wall 59 includes an upper portion 61 which is substantially shallower than a lower portion 63. In this way, the lower portion 63 and the upper portion 61 combine to support the speaker 52 at about a horizontal position from the ground. Preferably, the upper portion 61 and the lower portion 63 are adapted to direct the central axis of the transmitted sound upwardly and slightly rearwardly toward the ear.

An earpiece 65 connected to a jack 69 by a cable 67 permits the user to listen to the audio signal from the base station 12 privately. In this regard, the jack 69 is inserted into an opening (not shown) in the side wall portion 59. When the jack 69 is properly inserted into the opening, circuitry (not shown) transfers the audio signal from the speaker 52 to the earpiece 65. Although not shown, the circuitry required for switching the audio signal between the speaker 52 and the earpiece 65 is well known, and will not be described hereinafter in greater detail.

The earpiece 65 includes a rear portion 64 connected integrally to a forward portion 66, wherein an opening 62 is formed between the rear portion 64 and the forward portion 66 to receive the pinna portion of the ear. When the earpiece 65 is positioned on the ear, the rear portion 64 lies between the pinna portion and the head while the front portion 66 lies over the tragus portion of the ear and the ear canal.

A speaker 70 is disposed within a central area 68 of the front portion 66 to facilitate the private transmission of sound to the user. In this regard, the speaker 70 is positioned at about the entrance to the ear canal when the earpiece 65 is positioned on the ear.

A receptacle 44 is secured to the left leg portion 30 to removably receive the transceiver 71 therewithin. The receptacle 44 includes a back wall 43, a side wall 46, a front wall 48 and another side wall 49 which form an upper opening 85 to receive the transceiver 71. A pair of rivets 45 and 47 couple the back wall 43 to the left leg portion 30.

A flat bottom wall 82 connected to back wall 43, side wall 46 and front wall 48, and an angled bottom wall 84 connected to the bottom wall 82, front wall 48, side wall 49 and back wall 43, enclose the receptacle 44 to support the transceiver 71 within the receptacle 44. A pair of openings 86 and 88 in side wall 49 permit access to the transceiver 71 for controlling its operation. Another opening (not shown) in the angled bottom wall 84 enables the plug 56 to pass therethrough for coupling the transceiver 71 to the speaker 52.

Considering now the transceiver 71 in greater detail, the transceiver 71 includes a housing 73 adapted to be received within the receptacle 44 for enabling wireless communication between the user and the base station 12. A pair of push button selector switches 78 and 79 are aligned with openings 86 and 88, respectively, to permit the user to operate the switches 78 and 79 when the transceiver 71 is inserted in the receptacle 44.

The switches 78 and 79 facilitate the selection of a desired channel. For example, in a fast food restaurant environment, switch 78 may represent a channel A for communicating with a customer at a drive-through speaker/microphone station when switch 78 is depressed. Switch 79 may represent a channel B for communicating with restaurant employees when switch 79 is depressed. In this way, the user can selectively choose one channel or the other for enabling the user to communicate with either the customer or the employees.

The housing 73 includes an angled surface 74 having a group of openings 75 therethrough. The angled surface 74 is adapted to be directed substantially toward the mouth of the user when the transducer support assembly 10 is worn by the user. Disposed within the transceiver 71 is a microphone 80 positioned adjacent to the group of opening 75 to permit the user to transmit an audio signal to the base station 12. The microphone 80 is connected to the transceiver 71 by conventional circuitry (not shown).

Extending upwardly from the angled surface 74, and positioned adjacent to the group of openings 75, is a volume control switch or knob 76. The volume control switch 76 is connected to the transceiver 71 by conventional circuitry (not shown) to enable the user to adjust the volume of the audio signal received from the base station 12.

A socket (not shown) in the housing 73 is positioned by the opening in the angled bottom wall 84 when the transceiver 71 is inserted into the receptacle 44. The socket is adapted to receive the plug 56 for electrically connecting the speaker 52 and the earpiece 55 to the transceiver 71. A cable 77 connected to the transceiver 71, and extending substantially along the bottom surface 32, operates as an antenna to facilitate wireless communication between the transceiver 71 and the base station 12.

In the preferred embodiment just described, the apparatus 10 comprises a speaker 52 and a microphone 80 to permit the user to transmit and to receive audio signals from the base station 12. However, other combinations of transducers are also contemplated. In this regard, the microphone 80 could be replaced with another earpiece, similar to earpiece 65, to enable the user to receive the audio signals as stereophonic sound.

It will also be understood by one skilled in the art that the transceiver 71 could be a radio receiver to receive AM or FM radio reception.

Additional uses of the apparatus 10 are also contemplated. In this regard, the apparatus 10 may be adapted to carry the electrical equipment transmitting the audio signals. For example, the transceiver 71 might be replaced with a cassette tape player to enable the user to listen to cassette tapes while participating in an activity requiring the use of both hands.

In use, the neck support 20 is placed around the neck of a user to enable the right leg portion 28 and the left leg portion 30 to lie substantially flat on the chest of the user. As shown in FIG. 4, the neck support 20 rests on the upper body portion of the user, wherein the neck support 20 substantially simultaneously engages the chest and the back of the neck of the user. In this position, the assembly 10 is supported from above by the back of the neck at the neck engageable portion 24. The neck engageable portion 24 engages the neck of the user in an overlying substantially continuous manner to resist the neck engageable portion 24 from lifting away from the neck. Thus, the stiff leg portions 28 and 30 resist from swinging away from the body of the user when the user bends forwardly.

The movement of the assembly 10 is further limited by the strips 36 and 38. In this regard, the strips 36 and 38 engage the body of the user to frictionally limit the movement of the assembly 10 relative to the body of the user. Generally, the weight of the transceiver 71 exceeds the weight of the speaker assembly 50. As a result, there is an imbalance of weight around the neck. The strips 36 and 38, though, resist any inadvertent shifting motion which could arise due to the weight imbalance. In this way, the assembly 10 is substantially hindered from sliding along the body due to the weight of the transceiver 71.

Figure 5:
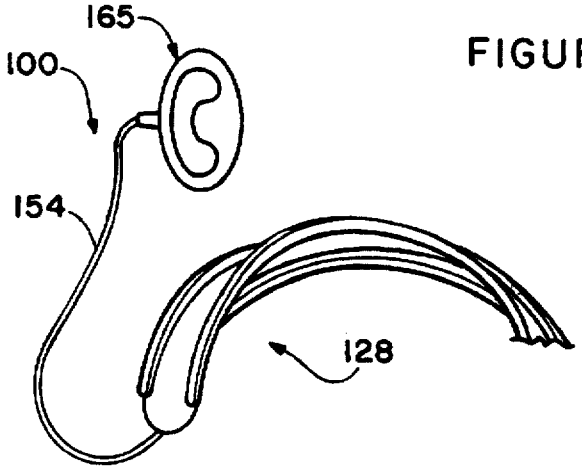
FIG. 5 is a cut-away view of another transducer support assembly which is also constructed in accordance with the present invention.

Referring now to FIG. 5, there is shown another transducer support assembly 100 which is also constructed according to the present invention. The assembly 100 is substantially similar to the assembly 10 except that the assembly 100 does not include a speaker assembly, such as the speaker assembly 50. As a result, the assembly 100 permits only the user to receive the audio signal transmitted from a base station, such as the base station 12 (FIG. 1), to the transceiver 71.

In this regard, the assembly 100 includes an earpiece 165 which is substantially similar to earpiece 65 (FIG. 1), and which is connected to a transceiver, such as transceiver 71 (FIG. 1), by a cable 154. The cable 154 extends from the right chest exchangeable leg portion 128 and permits the movement of the earpiece 165 relative to the right leg portion 128 for enabling the user to engage or disengage freely the earpiece 165 with the ear of the user.

Referring now to FIG. 6, there is shown another transducer support assembly 600 which is also constructed according to the present invention, and which is also substantially similar to the assembly 10. Unlike the assembly 10, however, the assembly 600 includes a U-shaped neck support 620 including a strap member 622 constructed from a metallic material. A sleeve 619 (FIGS. 6 and 7) constructed from a non-woven material surrounds the strap member 622 along substantially the entire length of the strap member 622 to form an underside surface 635 for engaging the body of the user.

To support a transceiver, such as a transceiver 71 (FIG. 1), the assembly 600 includes a receptacle 644 constructed from the non-woven material. The receptacle 644 includes a back wall 680, a side wall 681, a front wall 682 and another side wall 683 which form an upper opening 684 to receive a transceiver, such as a transceiver 71 (FIG. 1). A flat bottom wall 687 and an angled bottom wall 689 are connected to each other, and are also connected to walls 680, 681, 682, and 683 to enclose the bottom of the receptacle 644 to support the transceiver 71 therein.

A flap 648 is connected fixedly to the back wall 680 at about the opening 684, and is capable of extending over the opening 684 to the front wall 682 to help secure the transceiver 71 in the receptacle 644. A hooked material 646 secured to the front wall 682 cooperates with a looped material 649 secured to the free end of flap 648 to releasably couple the flap 648 to the front wall 682. A pair of openings 685 and 686 in side wall 683 permit access to channel selection switches of the transceiver 71 when it is inserted and secured within the receptacle 644.

The strap member 622 further includes a bent portion 629 for facilitating the support of the receptacle 644 and the transceiver 71 stored therewithin. Rivets 645, 647 secure the back wall 680 to the strap member 622, and rivet 649 secures the bottom wall 687 to the bent portion 629. In this way, the transceiver 71 is provided with additional support.

A cable 677 is provided for antenna purposes to enable the transceiver 71 to communicate with a base station, such as base station 12 (FIG. 1), in a wireless mode. A plug 679 releasably couples the cable 677 to the transceiver 71.

A cable 654 connects a speaker assembly 650 to a plug 656 for coupling the transceiver 71 to the speaker assembly 650. Both cables 677 and 654 are encased within the sleeve 619 to prevent the cables 677 and 654 from being caught in an object and thereby damaging the assembly 610.

Referring now to FIG. 8, there is shown another transducer support assembly 800, which is also constructed according to the present invention. The assembly 800 includes a transceiver 871 coupled to an earpiece 865 for communicating with remote communication equipment, such as a base station 12 (FIG. 1).

The transceiver 871 includes a housing 873 having a rear wall 875, and is coupled to a closed loop strap 820 for supporting the transceiver 871 from the neck of the user. A coupler 880 is fixed to the rear wall 875 for coupling the transceiver 871 to the body of the user.

The strap 820 includes a strap member 822 that passes through a sleeve 882 fixed to the coupler 880. A knot 823 at one end of the strap member 822 prevents the strap member 822 from passing completely through the sleeve 882 in one direction. Another strap member 824, which is substantially longer than strap member 822, is coupled at one end to the free end of strap member 822 by a buckle 890 to enable the size of the strap 820 to be adjusted.

The other end of strap member 824 passes through another sleeve 884 fixed on the coupler 880 and spaced apart from the sleeve 882. A knot 825 at the other end of strap member 824 prevents the strap member 824 from completely passing through the sleeve 884 in one direction.

The earpiece 865 is connected to a plug 856 by a cable 854 to help transmit an audio signal to the ear of the user. In this regard, the plug 856 is received within a socket (not shown) in the transceiver 871 to couple electrically the earpiece 865 to the transceiver 871.

The cable 854 extends from the plug 856 and passes through the sleeve 884 together with the strap member 824. To reduce the likelihood of contacting an object with the cable 854 and possibly damaging the assembly 800, the cable 854 is bonded to the strap member 824 by a conventional bonding technique. The cable 854 is separated from the strap member 824 at a departure point 826. The cable 854 extends from the departure point 826 and permits the earpiece 865 to be moved freely relative to the body of the user, thereby enabling the user to engage and disengage the earpiece 865 with the ear of the user.

In order to prevent the transceiver 871 from swinging away from the body of the user, the coupler 880 includes a clip 886 having a fixed base member 887. A resilient curved intermediate member 889 is connected integrally to the base member 887.

To grasp the clothing of the user, the clip 886 further includes a grasping member 888 connected integrally to the intermediate member 889. The grasping member 888 can be pivoted away from the base member 887 to permit an article of clothing to be placed between the base member 887 and the grasping member 888, wherein the intermediate member 889 tends to cause the grasping member 888 to apply an inwardly directed force to engage frictionally the article of clothing.

In use, the strap 820 is placed over the head of the user to engage the back of the neck of the user. The transceiver 871 is thereby positioned on the chest with the rear wall 875 facing the body of the user. By adjusting the relative lengths of strap members 822 and 824 with the buckle 890, the transceiver 871 can be positioned relative to the mouth to facilitate the communication of audio signals. Once the strap 820 has been adjusted suitably, the clip 886 is operated to engage and grasp the article of clothing.

Figure 10:
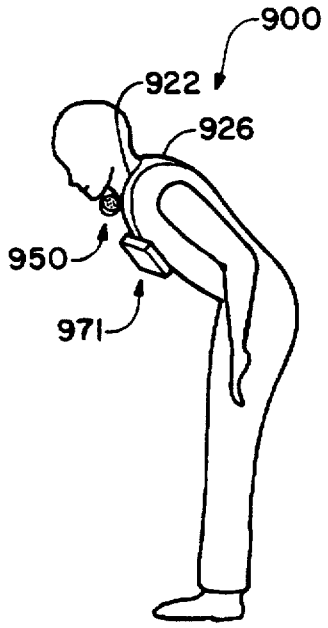
FIG. 10 is a diagrammatical view of the apparatus of FIG. 9 positioned on a user.
Figure 9:
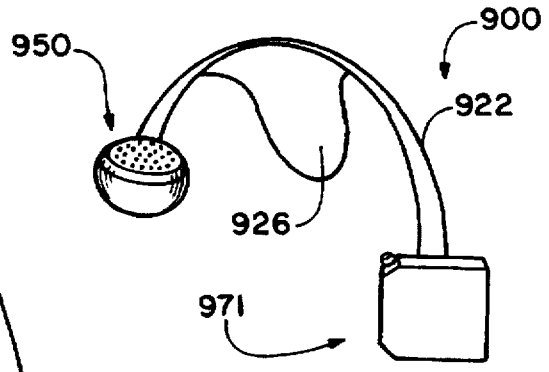
FIG. 9 a diagrammatical view of another transducer support assembly which is also constructed in accordance with the present invention.

Referring now to FIGS. 9 and 10, there is shown yet another transducer support assembly 900 which is also constructed according to the present invention. The assembly 900 includes a hook shaped strap member 922 having a speaker assembly 950 secured to one end of the strap member 922, and having a transceiver 971 secured to the other end of the strap member 922. Assembly 900 is substantially similar to assembly 10 (FIGS. 1–4), except that the strap member 922 is substantially narrower than strap member 22.

In order to resist the strap member 922 from lifting away from the back of the neck of the user, the assembly 900 further includes a stiff neck and back engaging member 926 for engaging the neck and back in a continuous substantially overlying manner. The member 926 operates to inhibit the stiff strap member 922 from swinging away from the body of the user.

As shown in FIG. 10, the assembly 900 remains in position on the body of the user even when the user bends forwardly. In this regard, the neck and back engaging member 926 prevents the strap member 922 from lifting away from engagement with the neck of the user. As a result, the speaker assembly 950 and the transceiver 971 do not swing away from the body of the user and, instead, remain in engagement with the chest of the user. Thus, the user is able to communicate in a hands free manner while performing tasks without being concerned that the transceiver 971 will swing away from the body of the user and interfere with the performance of the tasks.

Figure 11:
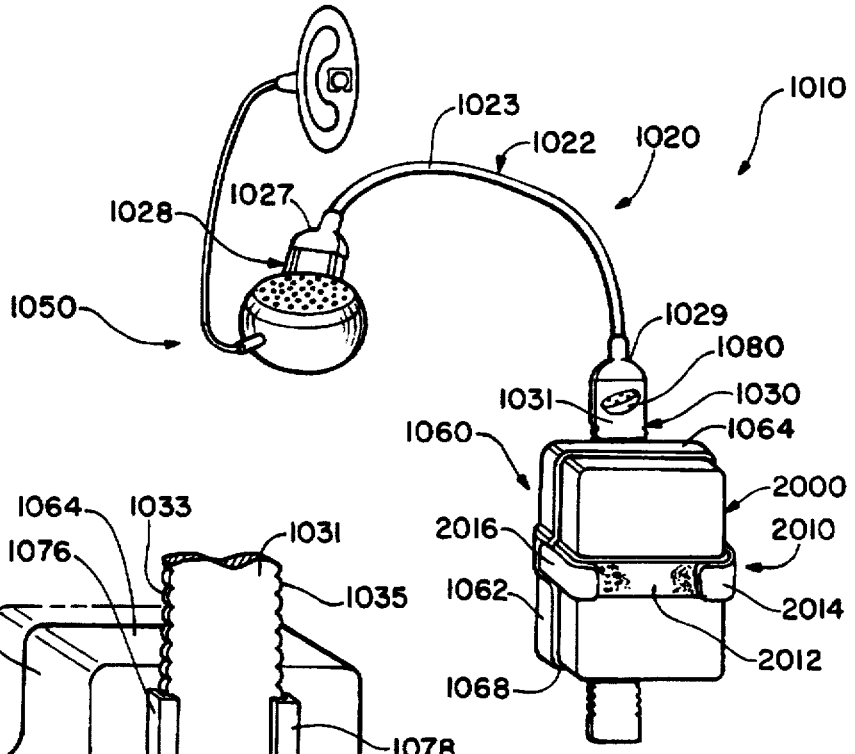
FIG. 11 is a front view of another transducer support assembly which is also constructed in accordance with the present invention.
Figure 13:
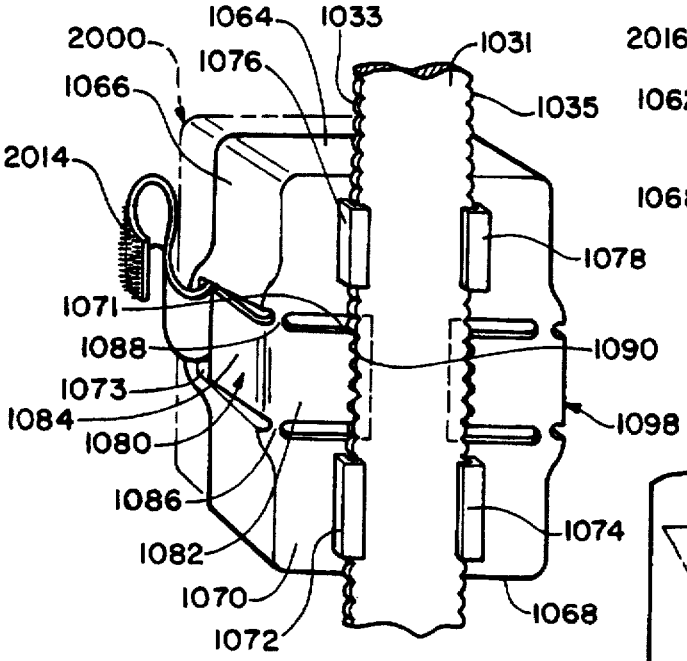
FIG. 13 is an enlarged cut-away rear perspective view of the transducer support assembly of FIG. 11.
Figure 12:
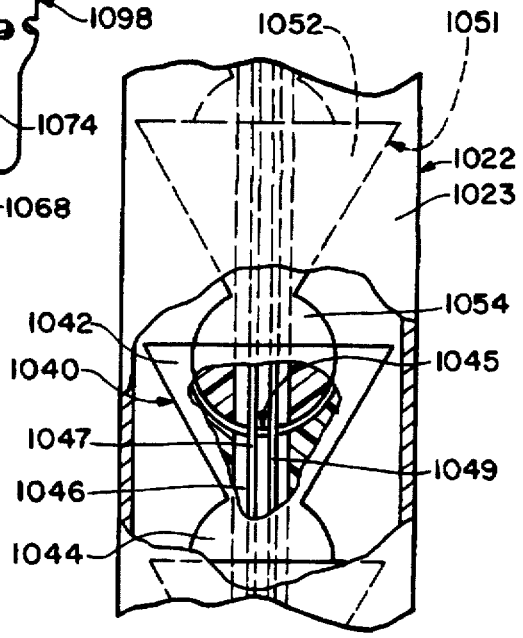
FIG. 12 is an enlarged cut-away view of the transducer support assembly of FIG. 11.

Referring now to FIGS. 11–13 of the drawings, there is shown another transducer support assembly 1010 which is also constructed in accordance with the present invention. The transducer support assembly 1010 is substantially similar to the transducer support assembly 10 (FIG. 1), and includes a U-shaped neck support 1020. A speaker assembly 1050 and a transceiver 2000 are coupled to opposite ends of the neck support 1020 to facilitate the communication of audio signals between a user and remote electrical equipment (not shown). The speaker assembly 1050 is substantially similar to speaker assembly 50 (FIG. 1) and is coupled to the transceiver 2000 by conductors, such as wires 1047 and 1049 (FIG. 12), contained within the neck support 1020.

The transceiver 2000 is substantially similar to the transceiver 71 (FIG. 1) and includes a volume control switch and channel selector switches (not shown) for controlling the operation of the transceiver 2000. Unlike the transceiver 71, though, the transceiver 2000 does not incorporate a microphone therein. Instead, a remotely located microphone is provided within a microphone housing 1080 mounted integrally to the neck support 1020, and which microphone is connected electrically to the transceiver 2000 by conductors not shown.

Considering now the neck support 1020 in greater detail with reference to FIGS. 11 and 12, the neck support 1020 includes a flexible neck engageable portion 1022 for supporting the neck support 1020 from above. A right chest engageable portion 1028 and a left chest engageable portion 1030 are coupled to the ends of neck engageable portion 1022 by adapters 1027 and 1029, respectively, for enabling the speaker assembly 1050 and the transceiver 2000 to be positioned on either side of the upper chest area of the user. The microphone housing 1080 is connected integrally to the left chest engageable portion 1030 and encloses the microphone therewithin for facilitating voice communication. The microphone housing 1080 is adapted to direct the microphone towards the mouth of the user to enhance the reception of the voice signals of the user.

In order to selectively position the transceiver 2000 relative to the neck support 1020, the neck support 1020 further includes a transceiver support 1060 coupled movably to the left chest engageable portion 1030 for securing the transceiver 2000 thereto and for enabling the transceiver 2000 to be fixed at a desired position relative to the left chest engageable member 1030.

Considering now the neck engageable portion 1022 in greater detail, the neck engageable portion 1022 includes a plurality of interconnected joint members, such as joint members 1040 and 1051, which are coupled pivotally to one another to enable the neck engageable portion 1022 to be adjusted for permitting the neck support 1020 to be worn by users of various sizes and shapes. A tubular sleeve 1023 constructed of rubber, plastic or the like encloses the joint members such as members 1040 and 1051 therewithin to prevent objects, including the hair of the user, from being caught between the joint members 1040 and 1051. The sleeve 1023 may have a relatively rough exterior surface to help reduce the movement of the neck engageable portion 1022 on the user.

The joint members such as members 1040 and 1051 include inverted cone portions 1042 and 1052 integrally connected to sphere portions 1044 and 1054. The sphere portion 1054 cooperates with the cone portion 1042 to define a ball and socket joint, wherein the sphere portion 1054 is pivotally secured within a socket 1045 of the cone portion 1042 to enable the joint members 1040 and 1051 to be reoriented relative to one another.

Sphere portion 1054 is held frictionally in place within the socket 1045 to limit the movement of joint member 1051 relative to Joint member 1040 for enabling the shape of the neck engageable portion 1022 to be maintained. Axial channels within the joint members 1040 and 1051, such as channel 1046 of joint member 1040, define a passageway within the neck engageable portion 1022 to permit wires, such as wires 1047 and 1049, to pass therethrough and connect electrically the speaker assembly 1050 to the transceiver 2000 in a substantially concealed member. The joint members 1040 and 1051 are commercially available, and may comprise, for example, the joint members marketed under the trade name POP BEADS which are manufactured by the Loc-Line Corporation.

Considering now the transceiver support 1060 in greater detail with respect to FIGS. 11 and 13, the transceiver support 1060 includes a base wall 1070 connected integrally to upstanding walls 1062, 1064, 1066 and 1068 to form a forward facing cup (not shown) to receive the transceiver 2000 therein. A pair of oppositely disposed L-shaped guide members 1072 and 1074 project rearwardly from the base wall 1070 and cooperate with another pair of oppositely disposed L-shaped guide members 1076 and 1078 which also project rearwardly from the base wall 1070 to retain slidably the left chest engageable portion 1030 therebetween.

The transceiver support 1060 further includes a pair of oppositely disposed pivotable L-shaped gripping members 1080 and 1098 for meshing with serrated edges 1033 and 1035 of the left chest engageable portion 1030 to act as a latching mechanism for preventing the transceiver support 1060 from sliding relative to the left chest engageable portion 1030. The gripping members 1080 and 1098 are coupled pivotally to the transceiver support 1060 to enable the gripping members 1080 and 1098 to be pivoted for selectively engaging the serrated edges 1033 and 1035.

In operation, the gripping members 1080 and 1098 are pivoted out of engagement with the serrated edges 1033 and 1035 to permit transceiver support 1060 to move relative to the left chest engageable portion 1030 for adjusting the assembly 1010 as desired. Releasing the gripping members 1080 and 1098 enables them to pivot back into engagement with the serrated edges 1033 and 1035 to mesh therewith for securing the transceiver support 1060 in the desired position on the left chest engageable portion 1030.

Considering the gripping members 1080 and 1098 in greater detail with respect to FIG. 13, only gripping member 1080 will be considered hereinafter in greater detail as gripping members 1080 and 1098 are substantially similar. The gripping member 1080 is connected integrally to the transceiver support 1060 by a pair of oppositely disposed connecting members 1086 and 1088 which form a living hinge to enable the gripping member 1080 to be pivoted for selectively engaging the serrated edge 1033. A pair of U-shaped openings 1071 and 1073 separate the gripping member 1080 from the base wall 1070 and the side wall 1066, respectively.

The gripping member 1080 includes an engaging member 1082 having a serrated edge 1090 for meshing with the serrated edge 1033, and a finger engageable member 1084 connected integrally and substantially perpendicularly to the engaging member 1082 for enabling the engaging member 1082 to be pivoted out of engagement with the edge 1033. In a resting position, the engaging member 1082 is substantially parallel to the base wall 1070 while the finger engageable member 1084 is substantially parallel to the side wall 1066.

In operation, the finger engageable member 1084 is pressed inwardly through the opening 1073 and into the cup, wherein the engaging member 1082 is simultaneously pivoted outwardly away from the base wall 1070 and out of engagement with the edge 1033 for enabling the transceiver support 1060 to be moved slidably relative to the left chest engageable portion 1030. The transceiver support 1060 is thus enabled to be moved slidably along the left chest engageable portion 1030 until the support 1060 is in the desired position. Once in the desired position, the finger engageable member 1084 is released, causing the engaging member 1082 to pivot back into engagement with the edge 1033 to fix the position of the transceiver support 1060 relative to the left chest engageable portion 1030.

A securing strap 2010 coupled to walls 1062 and 1066 helps to retain the transceiver 2000 within the cup. The strap 2010 is adapted to define a hook and loop securing arrangement having a looped portion 2012 which cooperates with hooked portions 2014 and 2016 to prevent the transceiver from unintentionally being released from within the cup. Hooked portions 2014 and 2016 pass through the U-shaped openings in walls 1066 and 1062, such as opening 1073 in wall 1062, and are reversely bent back over into engagement with looped portion 2012 to secure the hooked portions 2014 and 2016 thereto.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A transducer support assembly worn by a user for communicating with electrical equipment, comprising:

electrical transducer means for facilitating communication;

a U-shaped neck engageable support means adapted to be worn about and to be supported by the neck of the user during normal operation for positioning the transducer support assembly at about the upper body portion of the user, said transducer means being so constructed and arranged on said support means to be disposed adjacent to the head of the user when the support assembly is worn around and supported by the neck;

said support means including an elongated strap composed of stiff material and configured to conform generally to the body of the user for helping to maintain the position of the transducer support assembly on the upper body portion of the user, said strap having an elongated neck engageable portion for helping to support the transducer support assembly by engagement with the back of the neck of the user during normal operation;

said strap further having a pair of chest engageable leg portions connected integrally to the opposite ends of said neck engageable portion and adapted to fit over the shoulders of the user, said leg portions being adapted to lie substantially flat against the chest of the user, wherein said neck engageable portion and said leg portions each have a respective underside surface for defining a common continuous underside surface to conform to and to engage the body of the user when the support means is worn about the neck of the user during normal operation;

said neck engageable portion having a wide portion adapted to extend in overlying substantially continuous engagement with the neck or back for resisting said stiff strap from lifting said underside surface away from engagement with the neck of the user to help resist said leg portions from swinging inadvertently away from the body of the user when the user bends forwardly;

said neck engageable portion and said leg portions each further having friction means forming said common underside surface for engaging the neck and chest of the user to help limit inadvertent shifting movement of the transducer support assembly relative to the body of the user; and said support means further including a pair of intermediate twisted portions interconnecting said leg portions with said neck engageable portion to permit said common underside surface to conform substantially continuously to the body of the user for enabling the underside of said neck engageable portion to lie substantially flat against the back of the neck of the user while the underside of said leg portions lie substantially flat against the chest of the user.

2. A transducer support assembly according to claim 1, wherein said neck engageable portion is curved between said leg portions to help form said U-shaped support means and to conform to the shape of the neck of the user.

3. A transducer support assembly worn by a user for communicating with electrical equipment, comprising:

electrical transducer means for facilitating communication;

a U-shaped neck engageable support means adapted to be worn about the neck of the user for positioning the transducer support assembly at about the upper body portion of the user, said transducer means being so constructed and arranged on said support means to be disposed adjacent to the head of the user when the support assembly is worn around the neck;

said support means including an elongated strap composed of stiff material and configured to conform generally to the body of the user for helping to maintain the position of the transducer support assembly on the upper body portion of the user, said strap having an elongated neck engageable Portion for helping to support assembly from above the transducer support from the back of the neck of the user;

said strap further having a pair of chest engageable leg portions connected integrally to the opposite ends of said neck engageable portion and adapted to fit over the shoulders of the user, said leg portions being adapted to lie substantially flat against the chest of the user, wherein said neck engageable portion and said leg portions have a common continuous underside surface to conform to and to engage the body of the user when the support means is worn about the neck of the user;

said neck engageable portion having a wide portion adapted to extend in overlying substantially continuous engagement with the neck or back for resisting said strap from lifting said common underside surface away from the neck of the user to help resist said leg portions from swinging inadvertently away from the body of the user when the user bends forwardly;

said strap further having friction means forming said common underside surface for engaging the body of the user to help limit inadvertent shifting movement of the transducer support assembly relative to the body of the user;

wherein said neck engageable portion is curved between said leg portions to help form said U-shaped support means and to conform to the shape of the neck of the user, and said support means including a pair of intermediate twisted portions interconnecting said leg portions with said neck engageable portion to permit said common underside surface to conform substantially continuously to the body of the user for enabling the underside of said neck engageable portion to lie substantially flat against the back of the neck of the user while the underside of said leg portions lie substantially flat against the chest of the user; and wherein one of said leg portions is shorter than the other of said leg portions to form said strap into a hook shape for facilitating the placement of said support means about the neck of the user.

4. A transducer support assembly according to claim 3, wherein said transducer means includes a speaker means coupled to said one leg portion for positioning said speaker means adjacent to an ear of the user to help transmit an audio signal from the electrical equipment to the user.

5. A transducer support assembly according to claim 4, wherein said speaker means includes an earpiece attached to a cable extending from said one leg portion for facilitating the placement of said earpiece at the ear of the user.

6. A transducer support assembly according to claim 4, wherein said speaker means includes a speaker device and a speaker housing attached to said one leg portion for securing said speaker device, said speaker housing is adapted to direct sound emanating from said speaker device upwardly toward the ear of the user.

7. A transducer support assembly according to claim 6, further including an earpiece having a jack means for coupling said earpiece with said speaker means to enable said audio signal to be heard by the user only.

8. A transducer support assembly according to claim 4, further including electrical communication means to help supply said audio signal to said speaker means, and said support means further including a receptacle means attached to said other leg portion for removably receiving and securing said communication means within said receptacle means.

9. A transducer support assembly according to claim 4, further including another electrical transducer means to further facilitate communication between the user and the electrical equipment, wherein said another transducer means is coupled to said other leg portion for helping to position said transducer means and said another transducer means on either side of the head of the user.

10. A transducer support assembly according to claim 9, wherein said another transducer means includes a microphone means for enabling the user to transmit another audio signal from the user to the electrical equipment.

11. A transducer support assembly according to claim 10, further including a transceiver means having a transceiver housing for facilitating wireless communication between the user and the electrical equipment.

12. A transducer support assembly according to claim 11, wherein said another transducer means is disposed within said transceiver housing, said support means further including a receptacle means attached to said other leg portion for removably receiving and securing said transceiver means within said receptacle means.

13. A transducer support assembly according to claim 3, wherein said transducer means includes a microphone means coupled to said other leg portion for positioning said microphone means adjacent to the mouth of the user to help transmit an audio signal from the user to the electrical equipment.

14. A transducer support assembly according to claim 3, wherein said strap is constructed from a plastic material.

15. A transducer support assembly according to claim 14, wherein said strap includes a pair of elongated spaced apart ridges for stiffening the strap to help to resist said leg portions from swinging away from the body of the user.

16. A transducer support assembly according to claim 15, wherein said friction means includes at least one strip of a cushioning material secured to said strap for engaging the body of the user.

17. A transducer support assembly according to claim 3, wherein said strap is constructed from metal.

18. A transducer support assembly according to claim 17, wherein said friction means includes a non-woven material surrounding said strap for engaging the body of the user.

19. A transducer support assembly worn by a user for communicating with electrical equipment, comprising:

a transceiver means for transmitting communications between the electrical equipment and speaker means;

a flexible U-shaped neck engageable support means having a neck engageable member disposed integrally between a pair of chest engageable members and adapted to be worn about the neck of the user for positioning the transceiver means on the chest of the user at about the upper body portion of the user, wherein said chest engageable members are positioned on either side of the head of the user at about the upper chest thereof when the neck engageable support means is worn around the neck; and said neck engageable support means further including a transceiver support means coupled slidably to one of said chest engageable members for positioning adjustably said transceiver means relative to said neck engageable member;

wherein said neck engageable support means is adjusted to conform to the upper body of the user and said transceiver support means is positioned relative to said one chest engageable member to enable the transducer support assembly to be worn in a comfortable manner by users of various sizes and shapes.

20. A transducer support assembly according to claim 19, wherein said transceiver support means further includes a latch means for cooperating with said one chest engageable member to secure releasably said transceiver support means at a desired position thereon relative to said neck engageable member.

21. A transducer support assembly according to claim 19, wherein said neck engageable support means further includes a plurality of interconnected joint members coupled to one another for enabling said neck engageable support means to be adjusted to conform to the upper body of the user.

22. A transducer support assembly worn by a user for communicating with electrical equipment, comprising:

a transceiver means for transmitting communications between the electrical equipment and speaker means;

a flexible U-shaped neck engageable support means having a chest engageable member adapted to be worn about the neck of the user for positioning the transducer support assembly at about the upper body portion of the user, wherein said chest engageable member is positioned to one side of the head of the user at about the upper chest thereof when the transducer support assembly is worn around the neck; and said neck engageable support means further including a transceiver support means coupled slidably to said chest engageable member for positioning adjustably said transceiver means relative to said chest engageable member;

wherein said neck engageable support means is adjusted to conform to the upper body of the user and said transceiver support means is positioned relative to said chest engageable member to enable the transducer support assembly to be worn in a comfortable manner by users of various sizes and shapes;

wherein said transceiver support means further includes a latch means for cooperating with said chest engageable member to secure releasably said transceiver support means thereto; and wherein said transceiver support means further includes a pair of oppositely disposed guide members extending backwardly therefrom to retain slidably therebetween said chest engageable member.

23. A transducer support assembly according to claim 22, wherein said chest engageable member includes serrated edges for cooperating with said latch means to help limit the movement of said transceiver support means relative to said chest engageable member, and said latch means includes a pair of gripping members having gripping serrated edges coupled pivotally to said transceiver support means for meshing selectively said serrated edges with said gripping serrated edges to secure said transceiver support means to said chest engageable member at a desired position thereon.

24. A transducer support assembly worn by a user for communicating with electrical equipment, comprising:

a transceiver means for transmitting communications between the electrical equipment and speaker means;

a flexible U-shaped neck engageable support means having a chest engageable member adapted to be worn about the neck of the user for positioning the transducer support assembly at about the upper body portion of the user, wherein said chest engageable member is positioned to one side of the head of the user at about the upper chest thereof when the transducer support assembly is worn around the neck; and said neck engageable support means further including a transceiver support means coupled slidably to said chest engageable member for positioning adjustably said transceiver means relative to said chest engageable member;

wherein said neck engageable support means is adjusted to conform to the upper body of the user and said transceiver support means is positioned relative to said chest engageable member to enable the transducer support assembly to be worn in a comfortable manner by users of various sizes and shapes;

wherein said neck engageable support means further includes a plurality of interconnected joint members coupled to one another for enabling said neck engageable support means to be adjusted to conform to the upper body of the user; and wherein said joint members include a ball portion and a socket portion to enable adjacent joint members to form a ball and socket joint for permitting said adjacent joint members to be reoriented relative to one another, wherein a ball portion is received within a socket portion of an adjacent joint member, and wherein said adjacent joint members resist frictionally the reorientation thereof to permit the neck engaging support means to maintain its shape.

25. A transducer support assembly according to claim 24, wherein said neck engageable support means further includes a sleeve for enclosing said joint members to help prevent objects from being grasped thereby.

* * * * *